United States Patent [19]

Goodman

[11] 4,262,981

[45] Apr. 21, 1981

[54] PRINTED CIRCUIT BOARD CONNECTOR

[75] Inventor: David S. Goodman, Mission Viejo, Calif.

[73] Assignee: International Telephone and Telegraph Corporation, New York, N.Y.

[21] Appl. No.: 52,772

[22] Filed: Jun. 28, 1979

[51] Int. Cl.[3] ..... H01R 13/00

[52] U.S. Cl. ..... 339/17 C; 339/176 MP

[58] Field of Search ..... 339/17 C, 17 L, 18 C, 339/176 MP, 193 P

[56] References Cited

U.S. PATENT DOCUMENTS

| | | | |
|---|---|---|---|
| 2,905,921 | 9/1959 | Barwick | 339/193 P |
| 3,771,101 | 11/1973 | Elkins | 339/17 C |
| 3,865,454 | 2/1975 | Blinder | 339/17 C |
| 3,868,166 | 2/1975 | Ammon | 339/176 MP |
| 3,871,728 | 3/1975 | Goodman | 339/176 MP |
| 4,089,581 | 5/1978 | Schwindt | 339/176 MP |

FOREIGN PATENT DOCUMENTS

| | | | |
|---|---|---|---|
| 2619677 | 1/1977 | Fed. Rep. of Germany | 339/193 P |

*Primary Examiner*—Joseph H. McGlynn
*Attorney, Agent, or Firm*—Thomas L. Peterson

[57] ABSTRACT

A printed circuit board connector is disclosed wherein the pattern of the wire-wrap posts of the contacts in the connector is different from the pattern, and the spacing, of the contacting sections of the contacts which engage the printed circuit board. The bottom of the connector is in the form of a substrate containing plated-through holes which receive printed circuit board engaging contacts without wire-wrap posts, as well as feed-through contacts which are offset from the other contacts and joined thereto by conductive traces on the substrate. A second set of printed circuit board engaging contacts having wire-wrap posts may be provided wherein the contacting sections of the printed circuit board engaging contacts of the connector are positioned more closely than the spacing between the wire-wrap posts of the connector.

7 Claims, 3 Drawing Figures

PRINTED CIRCUIT BOARD CONNECTOR

BACKGROUND OF THE INVENTION

The present invention relates generally to a printed circuit board connector and, more particularly, to such a connector wherein the pattern, and spacing, of the printed circuit board engaging sections of the contacts are different than that of the wire-wrap posts of the connector.

In printed circuit board connectors employing contacts having wire-wrap posts, the posts must be arranged in a certain grid pattern which allows the posts to be wire-wrapped by standard machinery. However, printed circuit boards have recently been introduced having conductive pads on the edges thereof which have a spacing differing from the pattern of the wire-wrap posts of the connectors. For example, the conductive pad spacing may be 0.062 inch while a typical spacing for wire-wrap posts is 0.125 inch. While complex stamped and formed contacts could be utilized in the connectors to achieve the required close spacing of the contacting sections of the contacts for engaging the pads on the printed circuit board, this is not a practical solution due to the cost of manufacture of such contacts and the thickness of the transverse insulator walls of the connector housing which are required to isolate the contacts from each other.

U.S. Pat. No. 3,660,803 to Cooney discloses a printed circuit board connector having some features broadly similar to the present invention in which the lower portions of contacts in a printed circuit board connector are arranged in four rows whereas the contacting sections of the contacts are arranged in two coplanar rows on opposite sides of the printed circuit board receiving slot in the connector housing. The lower portions of the contacts are transversely aligned. The contacts require a very complex structure which allows the contacting sections of the contacts to be longitudinally adjacent to each other for engaging the printed circuit board. Cooney does not teach an arrangement wherein the longitudinal spacing of the contacting sections of the contacts is sufficiently close to engage the high density conductive pads on the edge of those printed circuit boards having a spacing of 0.062 inch.

The purpose of the present invention is to provide a printed circuit board connector utilizing relatively simple contacts which are inexpensive to manufacture, and in which the contacts are arranged so that the posts thereof are in a pattern suitable for wire-wrapping, yet the contacting sections of the contacts are disposed in a different pattern and sufficiently close to engage very closely spaced conductive pads on the edge of a printed circuit board.

SUMMARY OF THE INVENTION

According to the principal aspect of the present invention, there is provided a printed circuit board connector which embodies a substrate having at least two rows of plated-through holes therein. The rows are arranged so as to be longitudinally offset relative to each other. A set of printed circuit board engaging contacts are mounted in the holes in one of the rows. Feed-through contacts are mounted into holes in the other row. Conductive traces are formed on the substrate which interconnect the holes in the respective rows. An insulator housing is mounted over the contacts onto the substrate. The housing contains a printed circuit board receiving slot. The printed circuit board engaging contacts of the connector have contacting sections adjacent to the slot whereby said contacting sections are arranged in a pattern differing from the pattern of the feed-through contacts.

In a preferred embodiment, there is provided a second set of printed circuit board engaging contacts mounted in an additional row of plated-through holes in the substrate which is longitudinally aligned with the holes receiving the feed-through contacts so that the wire-wrap posts on the second set of contacts and the feed-through contacts are arranged in a standard grid pattern suitable for wire-wrapping. The contacting sections of the second set of printed circuit board engaging contacts may be located more closely longitudinally to the contacting sections of the first set due to the offset mounting arrangement of the first set of contacts provided by the present invention.

DESCRIPTION OF THE PREFERRED EMBODIMENT

Figure 1:
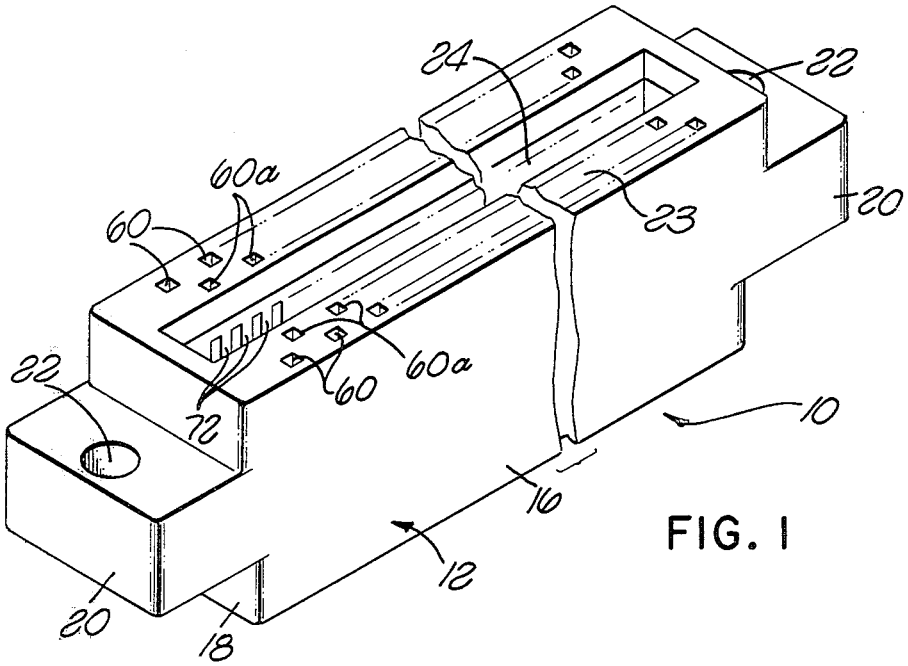
FIG. 1 is a perspective view showing the top of the connector of the present invention.

Referring now to the drawings in detail, the connector of the present invention, generally designated 10, comprises an insulator housing 12 mounted on a printed circuit board 14. The housing embodies parallel vertical sidewalls 16 joined by end walls 18 formed with outwardly extending mounting flanges 20 having openings 22 therein for receiving fasteners for attaching the connector to a suitable panel, frame, or the like, not shown. The upper wall 23 of the housing contains a longitudinally extending slot 24 for receiving the edge of a printed circuit board. The bottom of the housing 12 is open so that the sides and end walls of the housing may fit over the printed circuit board 14, which thus forms the lower wall of the housing. As will be seen more clearly later, the housing is retained on the board 14 by an interference fit between the housing and certain contacts mounted in the board.

The printed circuit board 14 comprises a substrate 25 containing four longitudinally extending rows of plated-through holes 26, 28, 30 and 32. The holes 26 and 28 are disposed on one side of slot 24 in housing 12 while the holes 30 and 32 are located on the opposite side of the slot. The four rows of holes are transversely aligned to thereby provide a plurality of lateral series of four holes wherein the holes 28 and 30 are the inner holes and the holes 26 and 32 are the outer holes. The holes 26, 28, 30 and 32 may be spaced apart longitudinally and laterally 0.125 inch which is a typical spacing for wire-wrapping of posts mounted in the holes.

Two additional rows of plated-through holes 34 and 36 are contained in the substrate 25 on opposite sides of the slot 24 and located between the inner and outer holes of the two rows located on opposite sides of the slot. The two rows of holes 34 and 36 are longitudinally offset from the four rows of holes 26, 28, 30 and 32, thereby providing individual offset holes between the lateral series of inner holes 28 and 30 and outer holes 26 and 32. Preferably, the offset holes 34 and 36 are equally spaced from the holes 26, 28, 30 and 32 and therefore, have a longitudinal spacing relative to such holes of 0.062 inch. It will be noted that the foregoing dimensions are given by way of example only and not by limitation.

Two rows of inner printed circuit board engaging contacts 40 and outer printed circuit board engaging contacts 42 are mounted on opposite sides of the slot 24 in housing 12. The outer contacts 42 are mounted in the outer holes 26 and 32 in the printed circuit board 14. However, rather than mounting the inner contacts 40 in the inner holes 28 and 30 in the board 14, as for example in the connector disclosed in the aforementioned Cooney patent, the contacts 40 are mounted in the offset holes 34 and 36, and feed-through contacts 44 for contacts 40 are mounted in the inner holes.

Each outer contact 42 comprises a wire-wrap post 46 and a spring arm 48, with the post and arm being interconnected by a central mounting portion 50. The contact is preferably stamped from suitable metal stock to provide the desired strength and resiliency.

The post 46 may be tapered at its tip end to facilitate insertion of the contact into a plated-through hole. The spring arm 48 includes a lower section 52 adjacent the mounting portion 50 which extends upwardly at an angle toward the slot 24 and then is reversely bent in the opposite direction to provide a curved contacting section 54 and an upper section 56. The upper section 56 terminates in an upper terminal section 58 which extends into a rectangular opening 60 in the upper wall 23 of the connector housing for preloading the contact in a manner well known in the art.

The central mounting portion 50 of the contact includes an enlarged laterally extending section 62 which is located above the printed circuit board 14. The enlarged section 62 provides upwardly facing shoulders 64 which may be engaged by a suitable tool to press the contact into a plated-through hole in the board 14. The mounting portion 50 of the contact has a width approximately equal to the diameter of the plated-through hole so that when the contact is pressed into the hole, it will have an interference with the wall of the hole. A tapered transitional section 66 provides width transition between the mounting portion 50 and the post 46.

Figure 2:
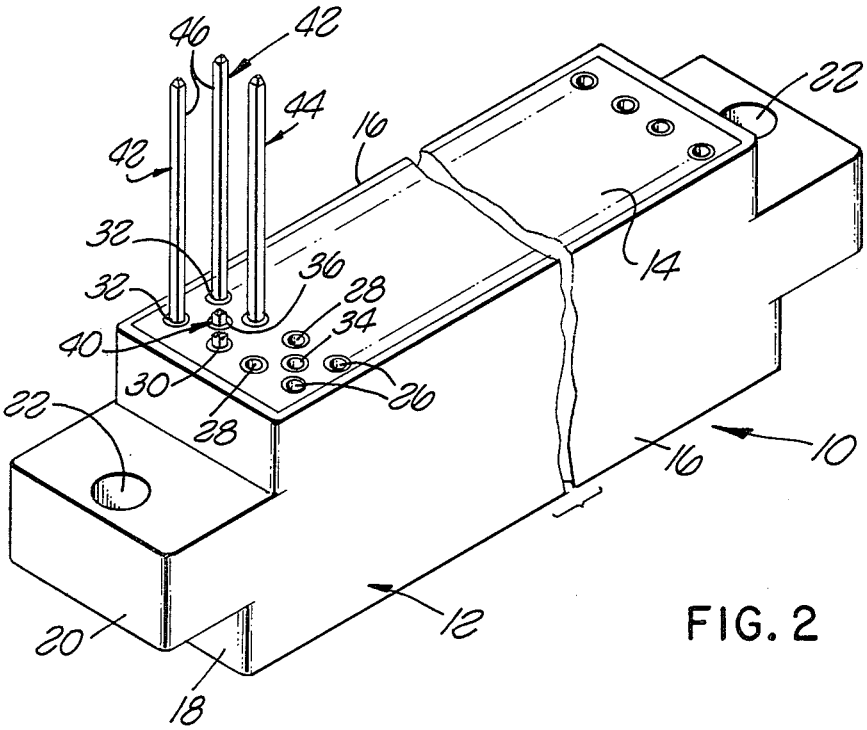
FIG. 2 is a perspective view illustrating the bottom of the connector, showing the lower sections of four of the contacts of the connector.

Each inner contact 40 is identical to the outer contact 42 except that the wire-wrap post has been removed, as best seen in FIG. 2, and the lower section **52*a* of the spring arm 48*a* extends upwardly at an angle relative to the board 14 greater than that of the spring arm 48 of contact 42 so that the curved contacting section 54*a* of each inner contact lies in a common vertical plane with the contacting section 54 of each outer contact 42. The upper terminal portion 58*a* of each inner contact extends into a rectangular opening 60*a* in the upper wall 23 of the housing which is located closer to the slot 24 than the corresponding opening 60 for the contact 42. It will be appreciated, therefore, with the outer contacts 42 mounted in the outer holes 26 and 32 in the printed circuit board 14, and the inner contacts 40 mounted in the offset holes 34 and 36, the curved contacting sections 54 and 54*a* of the two rows of contacts will be spaced longitudinally apart 0.062 inch, corresponding to the longitudinal spacing of the offset holes and outer holes in the board. Thus, close longitudinal spacing of the contacting sections of the contacts on the opposite sides of the slot 24** is achieved by the present invention without the requirement of the use of complex stamped and formed contacts.

The feed-through contacts 44 are similar to the contacts 42 except that they are devoid of a spring contacting arm. Thus, each feed-through contact terminates at its upper end in an enlarged section **62*b*. The wire-wrap post 46*b* of each feed-through contact 44 extends below the board 14 in lateral alignment with the post 46 of the outer contact 48 thus properly positioned for wire-wrapping. The feed-through contacts 44 are electrically connected to the inner contacts 40 by conductive traces 70 on the upper side of the board interconnecting adjacent plated-through holes 30 and 36, and 28 and 34, respectively. Hence, by the present invention, not only are the contacting sections 54 and 54*a* of the printed circuit board engaging contacts positioned more closely than hereto possible with the use of simple stamped contacts, the wire-wrap posts 46 and 46*b*** of the connector are arranged in a grid pattern suitable for wire-wrapping.

In an alternative arrangement, printed circuit board engaging contacts could be mounted in the inner holes 28 and 30 in the board 14 and the feed-through contacts 44 could be mounted in the outer holes 26 and 32, in which case the traces 70 would connect the offset holes 34 and 36 with the corresponding outer holes containing the feed-through contacts.

Figure 3:
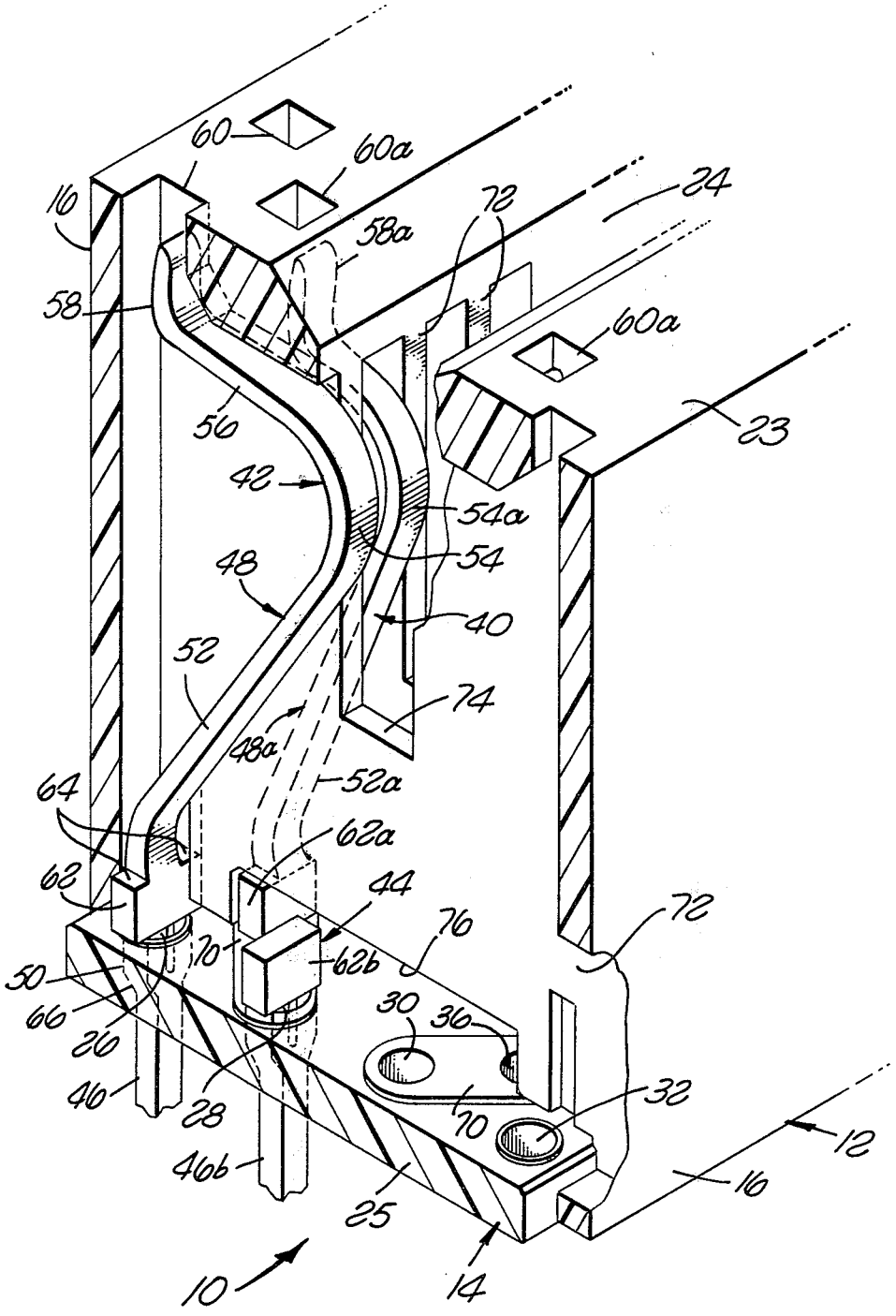
FIG. 3 is an enlarged perspective view, in cross-section, of the connector with some of the contacts removed for purposes of clarity.

As seen in FIG. 3, the insulator housing 12 embodies transverse walls 72 which separate the spring arms of the inner and outer contacts 40 and 42. Each wall embodies a central vertical slot 74 for receiving a printed circuit board inserted through the longitudinal slot 24 in the upper wall of the housing. The bottoms of the slots 72 provide a stop 74 limiting insertion of a board into the connector housing. A recess 76 is provided at the lower end of each wall 72 into which the sides of the enlarged sections **62*a* and 62*b* of the inner contacts and feed-through contacts may freely extend. Vertical grooves 78 are formed in the sides of the wall 72 adjacent to the outer contacts 42 and aligned with the enlarged sections 62 of such contacts. The enlarged sections 62 of the outer contacts and the grooves 78 are dimensioned to provide an interference fit therebetween whereby, after mounting the contacts initially in the board 14 and mounting the housing 12 over the contacts onto the board, the housing will be retained on the board by such interference fit. Alternatively, the interference fit could be provided between the inner contacts 40 and the transverse walls 72 of the housing, or the housing could be retained on the board 14** by separate fastening means.

What is claimed is:

1. A printed circuit board connector comprising:

a substrate having first and second rows of plated-through holes therein, said rows being longitudinally offset relative to each other;

a first set of printed circuit board engaging contacts mounted in the holes in said first row, said first set of contacts being devoid of wire-wrap posts;

individual, spaced apart feed-through contacts mounted in the holes in said second row, said feed-through contacts embodying wire-wrap posts extending substantially below said substrate;

conductive traces on said substrate interconnecting each of said holes in said first row with a corresponding one of said holes in said second row;

said substrate having a third row of plated-through holes therein, said holes in said third row being transversely aligned with said holes in said second row;

a second set of printed circuit board engaging contacts mounted in said holes in said third row, said second set of contacts embodying wire-wrap posts extending substantially below said substrate;

an insulator housing mounted over said contacts onto said substrate;

said housing containing a printed circuit board receiving slot;

said three rows of holes being on one side of said slot;

said first and second sets of printed circuit board engaging contacts having coplanar contacting sections adjacent to said slot, the longitudinal spacing between the contacting sections of said printed circuit board engaging contacts being less than the longitudinal spacing between the wire-wrap posts of said feed-through contacts and said second set of contacts; and said feed-through contacts being devoid of contacting sections for engaging a printed circuit board inserted into said slot.

2. A printed circuit board connector as set forth in claim 1 wherein:

said holes in said first row are approximately midway longitudinally between the longitudinally aligned holes in said second and third rows of holes whereby the contacting sections of said first and second sets of contacts are spaced apart longitudinally a distance approximately one-half of the longitudinal distance between said holes in said second and third rows.

3. A printed circuit board connector as set forth in claim 1 wherein:

each contact of said first and second sets of printed circuit board engaging contacts embodies a mounting portion mounted in its corresponding hole in said substrate and a spring section between said mounting portion and contacting section extending transversely toward said slot; and said spring sections of said first set of contacts being disposed at an angle relative to said substrate greater than the spring sections of said second set of contacts.

4. A printed circuit board connector as set forth in claim 1 wherein:

said substrate is mounted within said housing.

5. A printed circuit board connector as set forth in claim 1 wherein:

said housing embodies transverse walls separating said first and second sets of contacts.

6. A printed circuit board connector as set forth in claim 5 wherein:

each contact in said first and second sets and each said feed-through contact includes an enlarged section above its mounting portion and located above said substrate;

each said transverse wall embodies on one of its sides a vertical groove receiving the enlarged section of a contact of said second set; and each said transverse wall embodies a downwardly opening recess which receives the enlarged section of a contact of said first set and the enlarged section of a feed-through contact.

7. A printed circuit board connector comprising:

a substrate;

an insulator housing mounted on said substrate having a printed circuit board receiving slot therein;

four rows of plated-through holes in said substrate, two of said rows being on one side of a vertical plane passing longitudinally through said slot and the other two rows being on the opposite side of said plane;

said four rows of holes being transversely aligned to provide a plurality of lateral series of four holes defining two inner holes and two outer holes;

two additional rows of plated-through holes in said substrate each on opposite sides of said plane and located between said inner and outer holes;

said additional rows of holes being longitudinally offset from said four rows of holes thereby providing offset holes between said lateral series of inner and outer holes;

printed circuit board engaging contacts mounted in said offset holes and one of either said inner or outer holes of said lateral series of holes, said printed circuit board engaging contacts having contacting sections adjacent to said slot for engaging a printed circuit board inserted therein;

feed-through contacts mounted in the other of said inner or outer holes;

said feed-through contacts being devoid of contacting sections for engaging a printed circuit board inserted into said slot;

conductive traces on said substrate interconnecting said offset holes and the other of said inner or outer holes on the respective sides of said plane;

said contacts in said inner and outer holes embodying wire-wrap posts extending substantially below said substrate;

said contacts in said offset holes being devoid of wire-wrap posts; and the longitudinal spacing between the contacting sections of said printed circuit board engaging contacts being less than the longitudinal spacing between said wire-wrap posts.

* * * * *